United States Patent [19]

Sato et al.

[11] Patent Number: 4,901,434

[45] Date of Patent: Feb. 20, 1990

[54] APPARATUS FOR TERMINATING MULTICONDUCTOR CABLE BY PRESSURE CONNECTION

[75] Inventors: Kensaku Sato; Shigetomo Sakabe, both of Tokyo, Japan

[73] Assignee: Hirose Electric Co., Ltd., Tokyo, Japan

[21] Appl. No.: 878,027

[22] Filed: Jun. 24, 1986

[30] Foreign Application Priority Data

Nov. 15, 1985 [JP] Japan ..... 60-174891
Nov. 20, 1985 [JP] Japan ..... 60-258573

[51] Int. Cl.[4] ..... H01R 43/04
[52] U.S. Cl. ..... 29/753
[58] Field of Search ..... 29/857, 861, 862, 863, 29/564.6, 882, 753, 866

[56] References Cited

U.S. PATENT DOCUMENTS 4,031,613 6/1977 Brown et al. ..... 29/753 X
4,383,364 5/1983 Casey ..... 29/863

FOREIGN PATENT DOCUMENTS 3521944 12/1986 Fed. Rep. of Germany ..... 29/749

*Primary Examiner*—Timothy V. Eley
*Attorney, Agent, or Firm*—Takeuchi Patent Office

[57] ABSTRACT

Apparatus for connecting by pressure a plurality of insulated conductors of a multiconductor cable to a plurality of contact terminals spaced at equal intervals along a terminal strip, which includes; (a) a feed rail for guiding the terminal strip; (b) a sprocket wheel engageable with apertures spaced on the terminal strip for guiding it along the feed rail; (c) a step motor for driving the sprocket wheel; (d) a cable support for moving the cable toward the terminal strip on the feed rail to insert the front ends of the cable into the contact terminals; and (e) a device for simultaneously pressing a plurality of the contact terminals into a plurality of insulated conductors of the cable.

11 Claims, 8 Drawing Sheets

APPARATUS FOR TERMINATING MULTICONDUCTOR CABLE BY PRESSURE CONNECTION

BACKGROUND OF THE INVENTION

1. Field of the Invention

The present invention relates to apparatus for connecting by pressure insulated conductors of a multiconductor cable.

2. Prior Art

As electronic equipment has become more compact in recent years, flat and multicore cables or connectors used for them have similarly become more compact. For example, the interval of conductors of a flat cable is relatively easy to reduce to 2.54 mm, but the interval of contact terminals arranged along a terminal strip has been larger (for example 5.08 mm) than that of the conductors so as to assure satisfactory contact spring force when the contact terminals are stamped out of a metal sheet.

Japanese Patent Publication No. 48-36,316 crimping discloses a method and terminal of a terminal strip to an end of a flat cable. However, in this method, whenever one conductor of a flat cable is crimped to one contact terminal, the flat cable must be moved laterally by one conductor interval for crimping next conductor. As a result, the prior crimping apparatus must repeat the same number of crimping operations as that of conductors of a flat cable and is low in operation efficiency.

Although crimping machines have been used to unite respective conductors of a multicore round or flat cable with respective contacts or connectors, these machines unite respective conductors and contacts or connectors one by one. That is, these machines have had no devices for positioning respective conductors of a multicore cable so that it is necessary to repeat the crimping operation as many as the number of conductors of the cable. Thus, the larger the number of conductors, the longer the operation time, increasing the crimping cost.

SUMMARY OF THE INVENTION

It is an object of the invention to provide apparatus connecting by pressure contact terminals with only a few connecting operations regardless of the number of conductors of a cable.

It is another object of the invention to provide apparatus equipped with a positioning device for positioning the work on the support simultaneously in two directions at right angles, thus speeding up the subsequent operation with high quality.

In accordance with one aspect of the invention there is provided an apparatus for connecting by pressure a plurality of contact terminals spaced at equal intervals along a terminal strip, which includes; a feed rail for guiding the terminal strip; a sprocket wheel engageable with apertures spaced on the terminal strip for guiding it along the feed rail; a step motor for driving the sprocket wheel; a cable support for moving the cable toward the terminal strip on the feed rail to insert the front ends of the cable into the contact terminals; and means for simultaneously crimping a plurality of the contact terminals to a plurality of conductors of the cable.

According to another aspect of the invention there is provided apparatus for connecting by pressure terminal to conductors, wherein the contact terminals are spaced at intervals at least twice greater than those of the conductors and moved at least one interval of the conductors at once for the same distance by each predetermined number of movements by means of the sprocket wheel, and the cable can be advanced or retracted by the cable support.

In accordance with a still another aspect of the invention there is provided apparatus equipped with a positioning device, which includes a base with a groove; a slidable support fitted in the groove; a first guide mounted on the slidable support against which a side of the work is abutted for positioning; a holder for holding the work positioned along the first guide in place on the slidable support; a second guide for positioning an end of the work held on the slidable support by the holder along the first guide; and a device for lowering the guide below the horizontal plane in which the slidable support is moved.

According to a yet another aspect of the invention there is provided apparatus equipped with a positioning device, wherein the lowering device includes a solenoid secured to the bottom of said base and a link provided between the solenoid and the second guide.

Other and further objects, features and advantages of the invention will appear more fully from the following description in connection with the accompanying drawings.

DESCRIPTION OF THE PREFERRED EMBODIMENTS

Figure 1:
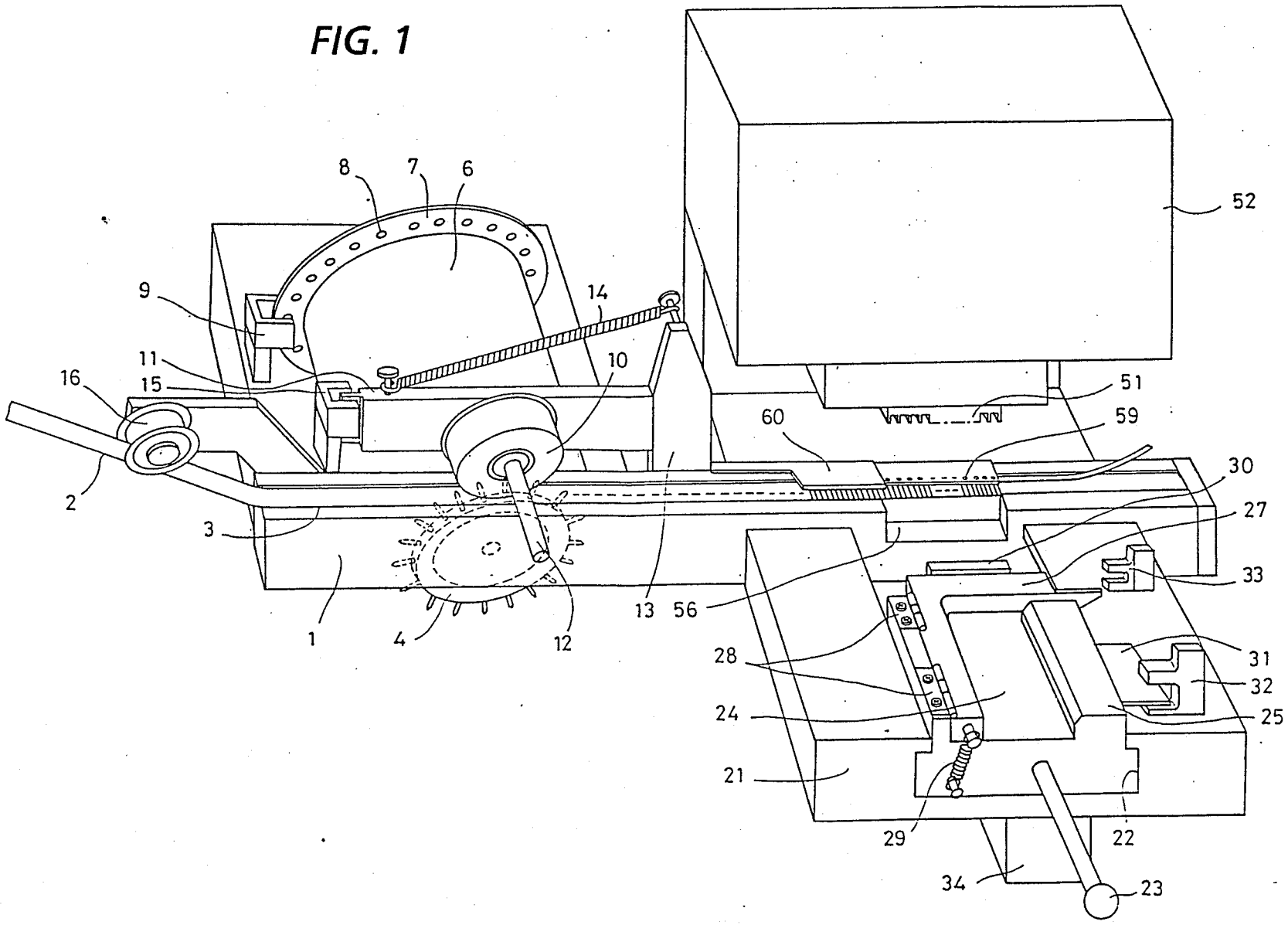
FIG. 1 is a perspective view of a connecting machine equipped with a positioning device embodying the present invention.
Figure 2:
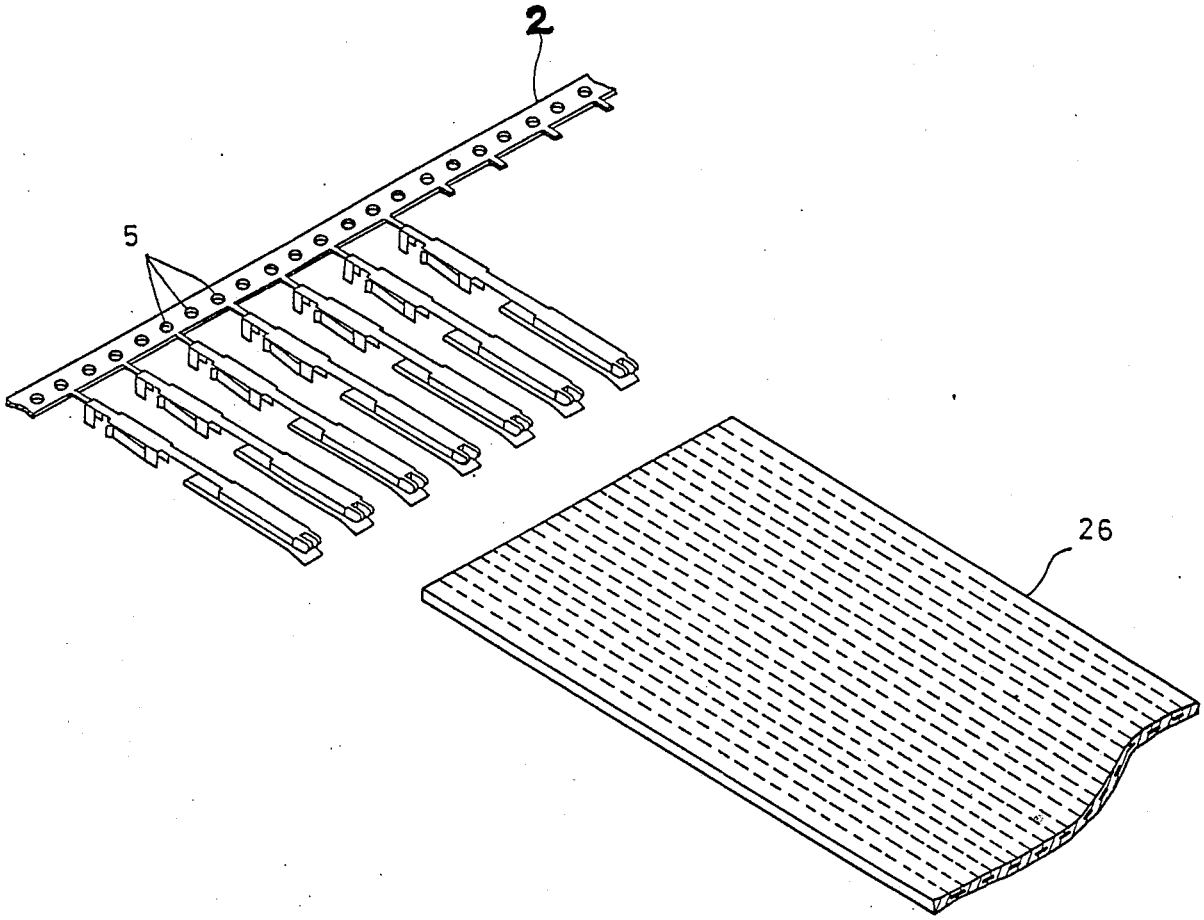
FIG. 2 is a perspective view of a flat cable and a terminal strip to be crimped by the machine.

Referring now FIG. 1 there is shown connecting machine which includes a contact terminal feed rail 1 having a guiding groove 3 for guiding a terminal strip 2 along the feed rail 1. A sprocket wheel 4 is mounted near the end of feed rail 1 to which a terminal strip is fed so that it may engage guiding apertures 5 spaced at equal intervals on the terminal strip 2. A step motor 6 is connected via a shaft to the sprocket wheel 4 for driving it intermittently. A disk 7 is fixed to the shaft of step motor 6 for sensing the number of pitches of terminal strip 2 fed. As apertures 8 spaced at equal intervals on the circumference of disk 7 pass through a sensor 9, the phototransistor of sensor 9 receives the light emitted from the light emitting diode for counting the number of aperture passages. A pressure roller 10 is pivoted with a shaft 12 to a fixing bar 11 for pressing the contact terminal strip 2 against the sprocket wheel 4, thus preventing the contact strip from coming up out of the guiding groove 3.

The fixing bar 11 is pivoted at its base to a stand 13, and a spring 14 is stretched between the free end of bar 11 and the stand 13 to not only facilitate the rotation of bar 11 but also prevent the pressure roller 10 from exerting excess pressure on the terminal strip 2. A sensor 15 is provided near the free end of fixing bar 11 to sense whether the pressure roller 10 is in the state of pressing the terminal strip 2. Unless the sensor 15 senses the pressure roller 10 in the position of pressing the terminal strip 2, the step motor 6 is kept from rotation. A guide roller 16 is provided in the vicinity of the guiding groove 3 for guiding the terminal strip 2 to the guiding groove from a supply source (not shown).

A base plate 21 is secured to one side of the feed rail 1 and has a groove 22 extending in the direction normal to the guiding groove 3. A slidable cable support 24, which can be manipulated with a lever 23, is fitted in the groove 22. A cable guide 25 is provided at one side of and in the sliding direction of cable support 24 to position a flat cable 26 in the sliding direction of cable support 24 by abutting one side of the flat cable against the cable guide. A cable holder 27 is rotatably attached to the other side of cable support 24 with hinges 28. To hold a cable, open the cable holder 27 against the pull of a coil spring 29, position a flat cable 26 along the cable guide 25, and then close the cable holder to hold the flat cable in place. The coil spring 29 is designed to exert a sufficient pressure on the flat cable 26 to prevent its movement. A cable stopper 30 is placed at the front end of cable support 24 to position the front ends of flat cable 26 when the cable support is in the retracted position from the feed rail 1. A position plate 31 is secured to the same side of cable support 24 as the cable guide and puts into operation a sensor 32 when the cable support is in the retracted position or a sensor 33 when the cable support is in the advanced position to the feed rail 1.

Figure 3:
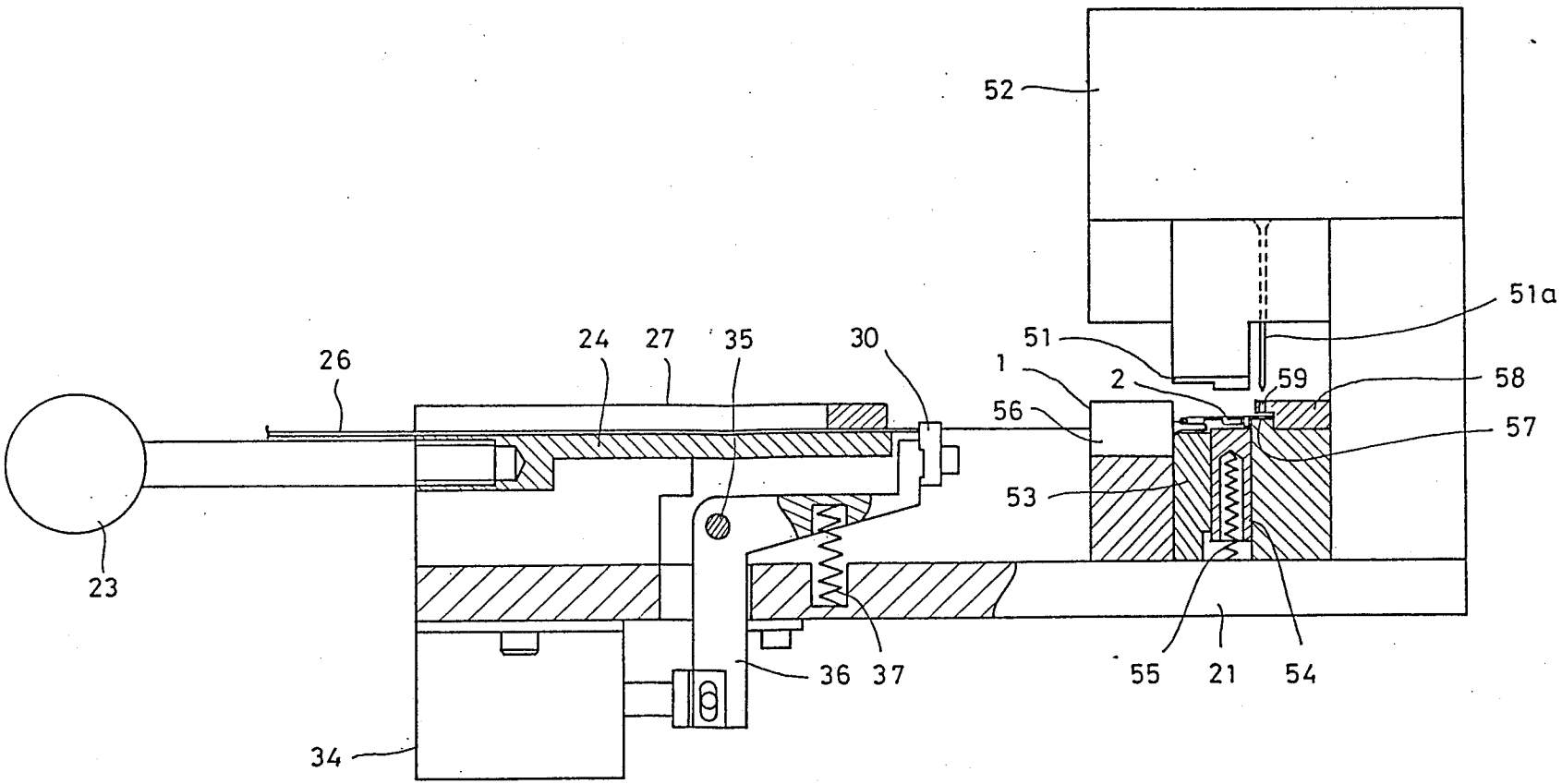
FIG. 3 is a sectional view of the connecting machine in which the front ends of a flat cable is positioned by the positioning device.
Figure 4:
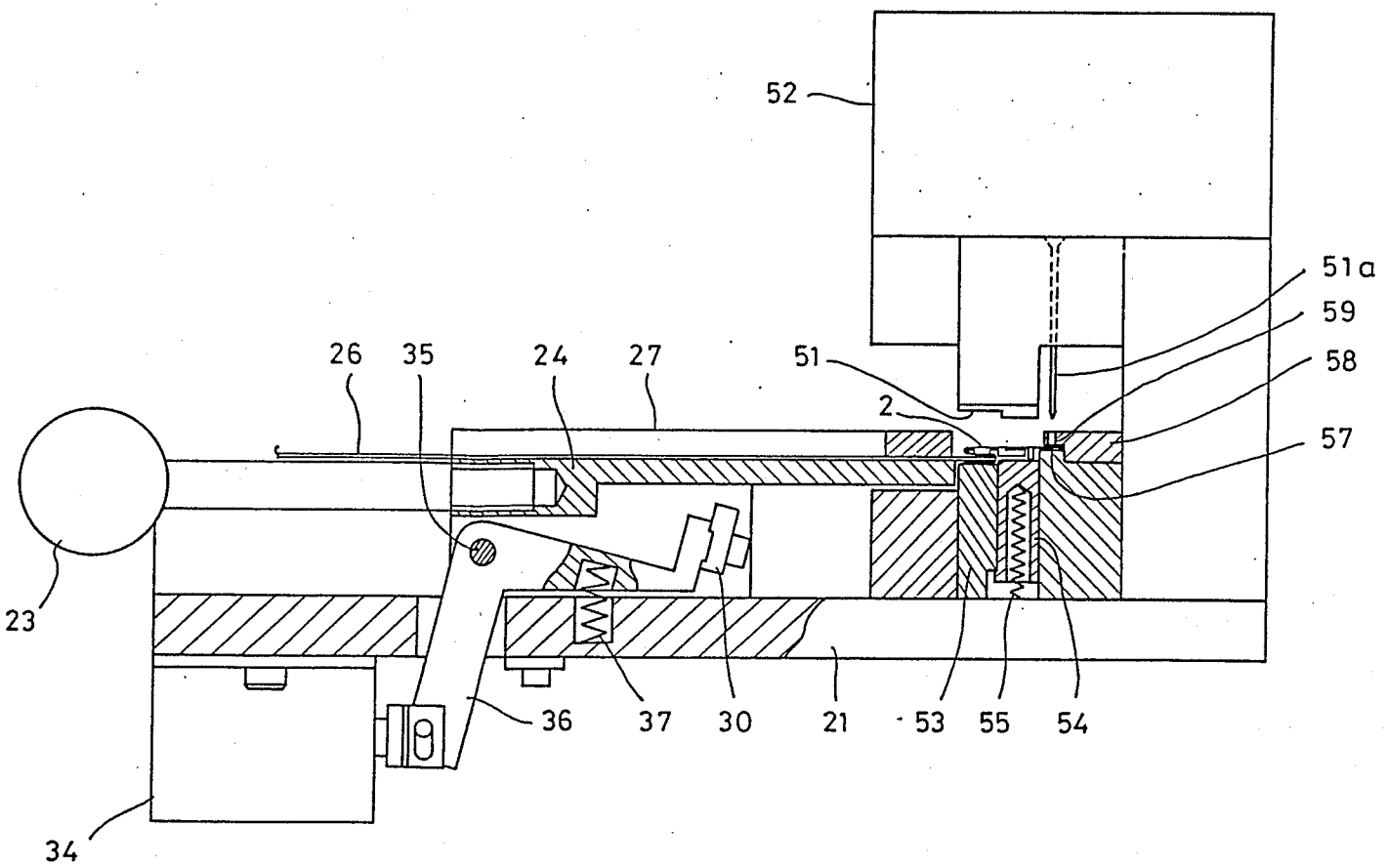
FIG. 4 is a sectional view of the connecting machine, with its cable support advanced to insert the front ends of a flat cable into respective contact terminals of the terminal strip.
Figure 6:
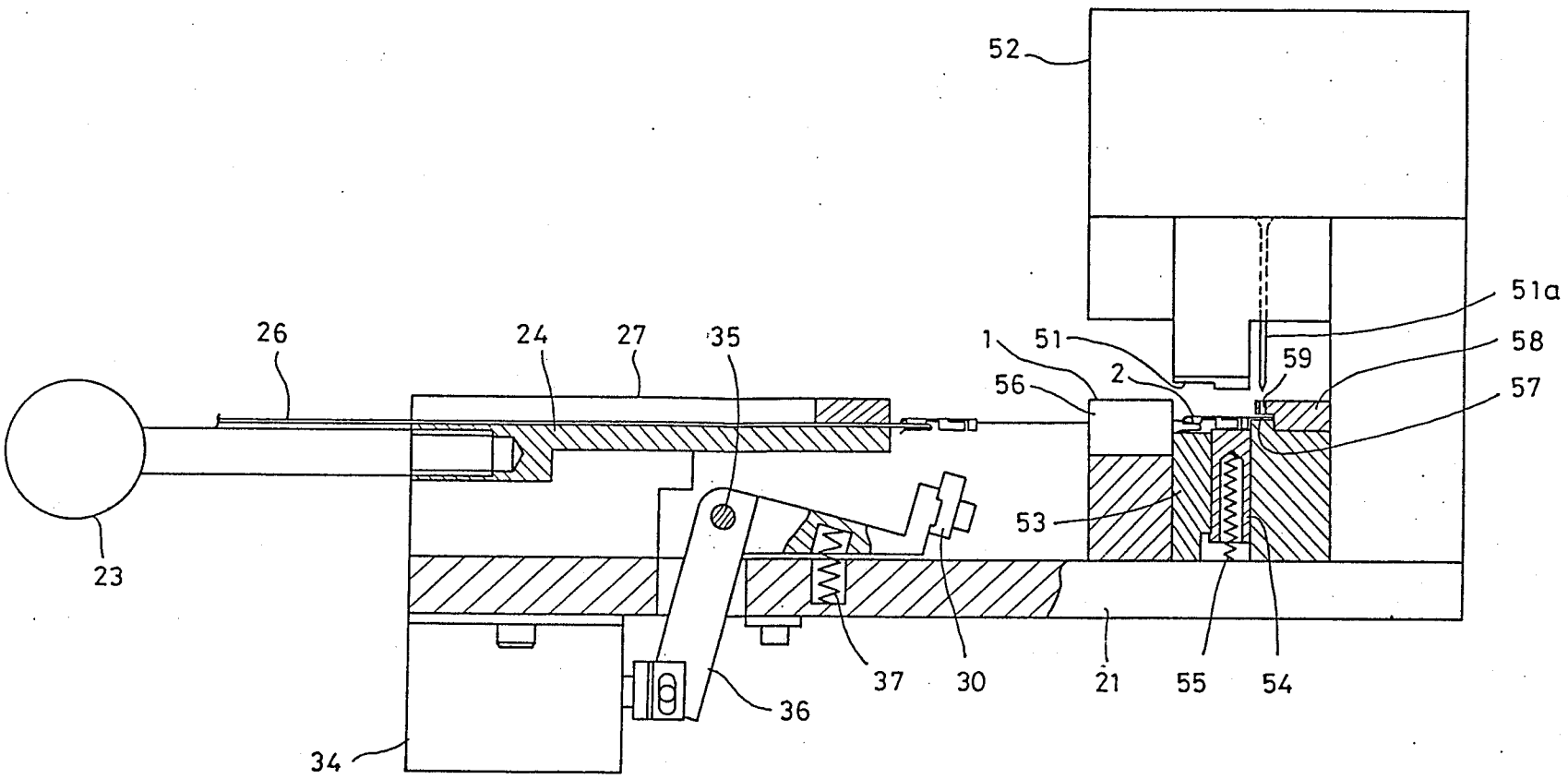
FIG. 6 is a sectional view of the connecting machine, with its cable support returned to the original position after the contact terminals are crimped to the ends of a flat cable.
Figure 5:
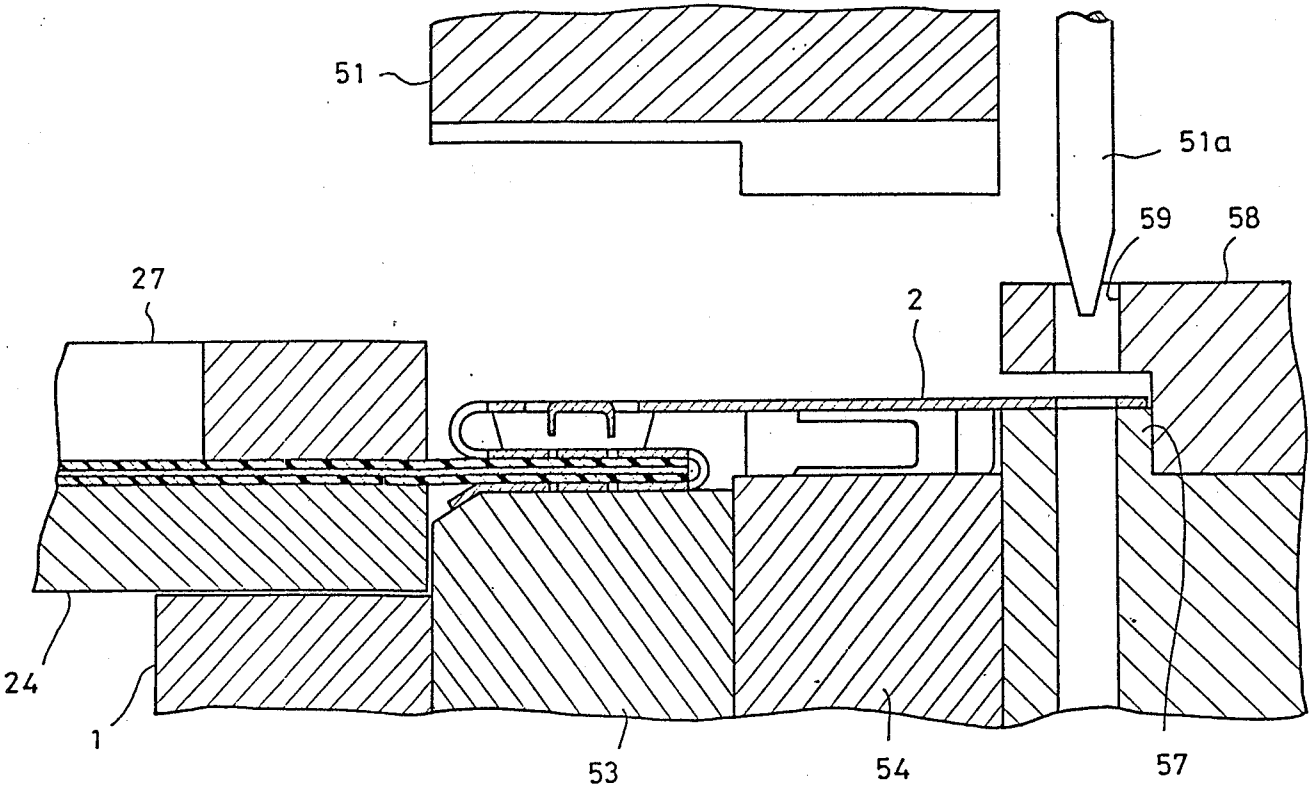
FIG. 5 is a sectional view of an enlarged upper punch approaching the lower punch.

As best shown in FIG. 3, a solenoid 34 is secured to the bottom of base plate 21 and, when the cable support 24 is advanced, energized by pressing a foot switch (not shown) to attract one end of a link 36 against a return spring 37, rotating it about a fulcrum 35 to lower the cable stopper 35. It is kept energized until the sensor 33 senses twice the presence of position plate 31 and the sensor 32 senses once the presence of position plate 31. By pressing again the foot switch after the flat cable 26 is removed, it is de-energized to release the end of link 36 for returning the cable stopper 30 to the original position under the influence of return spring 37.

An upper punch 51 is moved by an electric press 52 toward the terminal strip 2 placed on a lower punch 53 in the groove 3. The upper punch 51 has a number of projections for crimping respective contact terminals to the front ends of flat cable 26. The lower punch 53 has the corresponding projections for crimping the contact terminals in cooperation with the upper punch 51. A positioning pin **51*a* is provided near the rear side of upper punch 51 and moves along with the upper punch toward the lower punch 53. The lower punch 53 has a part 54 movable relatively to the rest of lower punch 53 against a buffer spring 55 under the pressure of upper punch 51. A recess 56 is provided in the feed rail 1 adjacent to the front side of lower punch 51 facing the cable support 24. The rear portion 57 of lower punch 53 is on level with the bottom of groove 3 in the feed rail 1 and supports the base of terminal strip 2. A guiding member 58 is provided above the rear portion 57 of lower punch 53 for guiding the positioning pin 51*a* and holding the base of terminal strip 2** in place for connection.

To connect terminals, first advance the cable support 24 toward the lower punch 53 to push the front ends of flat cable 26 into respective contact terminals of terminal strip 2 on the lower punch. Then, move the upper punch 51 and the positioning pin **51*a* toward the lower punch 53 by means of the electric press 52. The positioning pin 51*a* is inserted into the aperture 5 in the base of terminal strip 2 through the guiding hole 59 of guiding member 57. As the upper punch 51 pushes the movable part 54 of lower punch 53 toward the base plate 21, the respective contact terminals are severed from the base of terminal strip 2 with the rear edge of upper punch 51 and the front edge of rear portion 57 of the lower punch 53. As the upper punch 51 and the movable part 54 further moves toward the base plate 21, the individual terminals are pressed into the flat cable 26 between the front part of upper punch 51 and the fixed front part of lower punch 53. A hold plate 60 is provided in the vicinity of the lower punch 53 to prevent the terminal strip 2 from coming up out of the feed rail 1**.

In operation, a terminal strip 2 is fed from the supply source into the groove 3 of feed rail 1 through the guide roller 16 so that the sprocket wheel 4 may engage apertures 5 in the base portion of terminal strip 2. The fixing bar 11 is then closed to place the pressure roller 10 on the terminal strip 2. Then, the foot switch (not shown) is depressed to drive the step motor 6. The step motor is intermittently driven according to the number of presses of the foot switch to intermittently rotate the sprocket wheel 4. This advances intermittently the terminal strip 2 toward the lower punch 53. When the terminal strip 2 reaches a predetermined position on the lower punch 53, the pressing of the foot switch is stopped.

Next, the cable holder 27 is opened against the coil spring 29 for placing a flat cable 26 on the cable support 24. The flat cable is positioned by abutting one side against the cable guide 25 and the front end against the cable stopper 30. The cable holder 27 is then closed to hold the flat cable 26 in place by a spring force of the coil spring 29. Then, the foot switch (not shown) is depressed to energize the solenoid 34, lowering the cable stopper 30. Upon lowering the stopper, the cable support 24 is advanced toward the lower punch 53 by manipulating the lever 23 until the front ends of flat cable 26 are inserted into the connecting portions of respective terminals of the terminal strip 2. When the sensors 32 and 33 sense this condition, the electric press 52 is actuated to move the upper punch 51 down to the lower punch 53. The positioning pin **51*a* is inserted into the guide hole 59 of guiding member 58 and then the aperture 5 of terminal strip 2**.

The upper punch 51 pushes down the movable part 54 of lower punch 53 to the base plate 21, severing respective contact terminals from the terminal strip 2 with the rear edge of upper punch 51 and the front edge of rear portion 57 of the lower punch. As the upper punch 51 and the movable part 54 further move downward, the individual terminals are connected to the front ends of flat cable 26 between the front part of upper punch 51 and the fixed front part of lower punch 53. The pitches or intervals between the individual terminals of terminal strip 2 and individual conductors of flat cable 26 are usually 5.08 mm and 2.54 mm, respectively, so that the contact terminals are connected to every other conductors of flat cable 26. Upon completion of the connection, the upper and lower punches 51 and 53 are returned to the original positions respectively.

Then, the cable support 24 is retracted by manipulating the lever 24. When the cable support 24 is in the retracted position, the step motor 6 is automatically rotated by a predetermined number of pitches while the sensor 9 is counting the pitches. This advances the terminal strip 2 on the lower punch 53 by a half pitch or 2.54 mm from the previous connecting position. The cable support 24 is then advanced toward the lower punch 53 for repeating the above connecting operation.

Upon completion of the connecting operation, the cable support 24 is retracted by manipulating the lever 23, and the cable holder 27 is opened to remove the flat cable 26 from the cable support 24. the cable stopper 30 is raised by pressing the foot switch for connecting contact terminals to a new flat cable.

Figure 7:
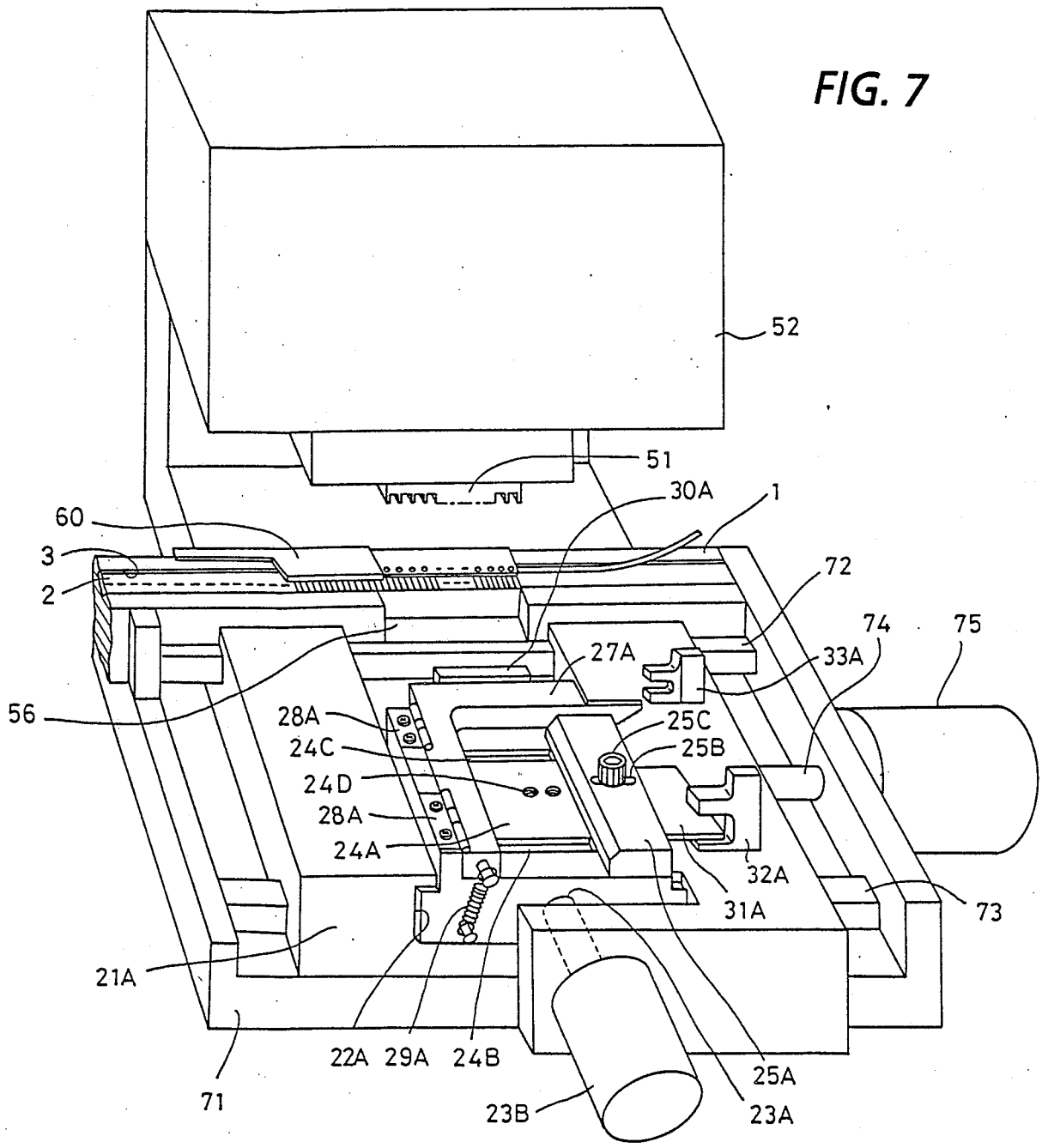
FIG. 7 is a perspective view of another embodiment according to the invention for connecting flat cable by pressure.

In the above illustrated embodiment, the number of conductors is constant, but the present invention is applicable to flat cables having different numbers of conductors. In this case, the cable support may be made movable along the feed rail according to the number of conductors of a flat cable. This embodiment will be described in more detail with reference to FIG. 7, in which the parts identical with those of FIGS. 1 through 6 are given the same reference numerals.

A slidable base 21A is mounted on a pair of guide rails 72 and 73 of a fixed base 71 secured to one side of the feed rail 1. The slidable base 21A is controlled by an air cylinder 75 and has a guiding groove 22A extending in the direction normal to the other guiding groove 3. A slidable cable support 24A is fitted in the guiding groove 22A and controlled by an air cylinder 23B through a rod 23A. A cable guide 25A is mounted on one side of the cable support 24A, against which one side of a flat cable 26 is to be abutted to position the cable in the direction parallel to the guiding groove 3. The cable guide 25A is slidably mounted on the cable support 24A along the guiding grooves 24B and 24C and set at a proper position with a positioning screw 25C that is inserted into a slot 25B with its major axis parallel to the guiding grooves 24B and 24C and threaded into one of the positioning hole 24D spaced at predetermined intervals such as the length of slot 25B. A cable holder 27A is attached to the other side of cable support 24A with a pair of hinges 28A.

To set a flat cable, first open the cable holder 27A against a coil spring 29A, position a flat cable 26 to the cable guide 25A, and then close the cable holder 27A to hold the flat cable 26 in place. The coil spring 29A is designed to exert a proper force on the flat cable thus preventing any displacement of the flat cable. A cable stopper 30A is located in front of the cable support 24A to position the front end of flat cable 26 when the cable support 24A is retracted or in the furthest position from the feed rail 1. A position plate 31A is secured to one side of the cable support 24A and puts a sensor 32A into operation when the cable support is in the retracted position and a sensor 33A into operation when the cable support is in the advance position or the closest to the feed rail 1.

Mounted on the bottom of movable base 21A is a solenoid 34 which is energized by depressing a foot switch (not shown) to lower the cable stopper when the cable support 24A is advanced. It is kept energized until the sensor 33A senses twice the presence of position plate 31A and the sensor 32A senses once the presence of position plate 31A. By depressing the foot switch again after the flat cable 26 is removed, it is de-energized to release the cable stopper 30A to the original position. The other structures are identical with those of the embodiment described in FIGS. 1 through 6, and their description is omitted.

In operation, first place a terminal strip 2 from a supply source in the guiding groove 3 of feed rail 1 through the guide roller 16 so that the sprocket wheel 4 may engage the aperture 5 of terminal strip 2. Close the fixing bar 11 to place the pressure roller 10 on the terminal strip 2, and then press the foot switch (not shown) for driving the step motor 6. The step motor is intermittently rotated according to the number of presses of the foot switch to intermittently rotate the sprocket wheel 4. This in turn intermittently moves the terminal strip 2 toward the lower punch 53. When the terminal strip 2 reaches the predetermined position of lower punch 53, stop pressing the foot switch.

Next, set the cable guide 25A at a proper position on the cable support 24A according to the width of a flat cable 26 to be connected by first loosing the positioning screw 25C, sliding the cable guide 25A along the slot and the grooves 24B and 24C, and then tightening the positioning screw 25C into a proper positioning hole 24D. Then, open the cable holder 27A against the coil spring 29A to place a flat cable 26 on the cable support 24A. The flat cable is positioned by abutting one side against the cable guide 25A and the front end against the cable stopper 30A. Close the cable holder 27A to hold the flat cable 26 in place by a spring force of the coil spring 29A. The solenoid is then energized by pressing another foot switch (not shown) to lower the cable stopper 30A. The air cylinder 23B is then actuated to advance the cable support 24A toward lower punch 53 through the rod 23A. The front ends of flat cable 26 is inserted into the connecting parts of individual terminals of terminal strip 2.

When this condition is sensed by the sensors 32A and 33A, the electric press 52 is operated to move the upper punch 51 down to the lower punch 53. The positioning pin **51*a* is inserted into the aperture 5 of terminal strip 2 through the aperture 59 of guiding member 58. As the upper punch 51 pushes the movable part 54 of lower punch 53 down to the bases 21A and 71, individual terminals are severed from the terminal strip 2 with the rear edge of upper punch and the front edge of rear portion 57 of the lower punch 53. As the upper punch 51 and the movable part 54 of lower punch 53 continue moving down to the bases 21A and 71, the respective terminals are connected to the front ends of flat cable 26 between the front part of upper punch 51 and the fixed front part of lower punch 53. The pitches or intervals between respective contact terminals of terminal strip 2 and individual conductors of flat cable 26 are 5.08 mm and 2.54 mm, respectively, so that contact terminals are connected to every other conductors of flat cable 26. Upon completion of the connecting operation, the upper and lower punches 51 and 53** are returned to their original positions.

Then, the cable support 24A is retracted by means of the air cylinder 23B and the rod 23A. When the cable support 24A is retracted, the step motor 6 is automatically energized to rotate by a predetermined number of pitches while the sensor 9 senses the number of pitches, moving the terminal strip 2 to the same position on the lower punch 53 as that of the previous crimping operation. The cable support 24A is automatically moved along the feed rail 1 to the right side by a half pitch or 2.54 mm. The cable support 24A is then advanced toward the lower punch 53 for repeating the same connecting operation as the previous one.

Upon completion of the connecting operation, the cable support 24A is retracted by means of the air cylinder 23B and rod 23A and moved along the feed rail 1 to the left side by a half pitch or 2.54 mm by means of the air cylinder 75 and rod 74. After the cable support 24A is returned to the original position, the cable holder 27A is opened to remove the flat cable 26 from the cable support 24A. After the cable stopper 30A is raised by pressing the other foot switch, the above operation may be repeated for connecting a new cable to contact terminals.

In the above embodiments, the interval of contact terminals of a terminal strip is twice the interval of conductors of a flat cable, but the invention is not necessarily limited to such a condition. For example, the interval of contact terminals may be three or more times as large as the interval of conductors. The cable stopper may be moved according to the movement of the cable support by using a sensor for sensing the cable support movement.

According to the invention, ends of a single flat cable may be inserted into and connected to a number of contact terminals of a terminal strip with a single operation, thus making the connecting operation efficient. Since the contact terminals of a terminal strip are arranged at intervals at lease twice times greater than those of the conductors of a flat cable, the distances shifted and moved by the contact terminals are equal to at least the interval of conductors and equal to that of a predetermined number of movements, respectively. Whenever the terminal strip is moved, connecting is made by the crimping machine, with the flat cable advanced and retracted by the cable support so that all the conductors of a flat cable are connected to contact terminals by only two cycles of connecting operations.

Figure 8:
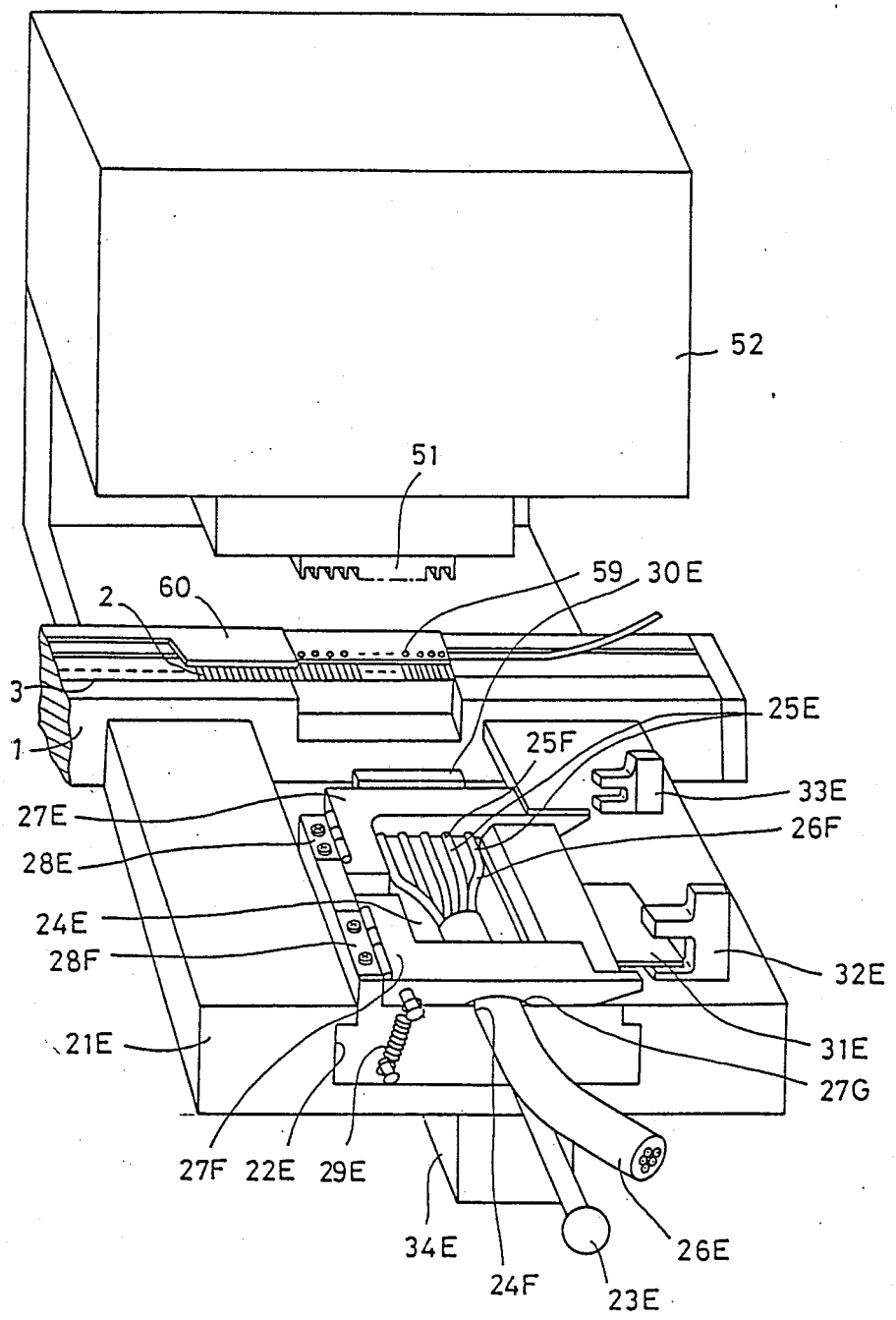
FIG. 8 is a perspective view of still another embodiment of the invention for connecting multicore round cable by pressure.

The present invention is also applicable to a multicore round cable. This embodiment will be described below with reference to FIG. 8, in which the same reference numeral represents an identical part with that of FIGS. 1 through 6.

A base 21E is secured to one side of the feed rail 1 and has a groove 22E extending in the direction normal to the guiding groove 3. A slidable cable support 24E is fitted in the groove 22E and controlled by manipulating a lever 23E. A plurality of cable guides or grooves 25E are provided on the cable support 24E at intervals in the direction parallel to the guiding groove 3 to position respective cable cores or conductors 26F of a multicore or multiconductor round cable 26E in the direction parallel to the guiding groove 3. A cable core holder 27E is attached to one side of cable support 24E with a hinge 28E.

To set a round cable, first open the cable core holder 27E against a coil spring (not shown), position respective cable cores 26F in the cable guide 25E, and then close the cable core holder 27E to hold the respective cable cores 26F in place. The coil spring is designed to exert a proper force on the cable cores, thus preventing any displacement of the cable cores. A plurality of grooves 25F are provided on the bottom of cable core holder 27E at the positions corresponding to the grooves 25E to ease the positioning of respective cable cores, but they may be eliminated if desired.

A round cable holder 27F is attached to the same side of cable support 24F as the cable core holder 27E with a hinge 28F. To set a round cable, first open the round cable holder 27F against a coil spring 29E stretched between the round cable holder and the cable support 24F and, after completion of the positioning of respective cable cores 26F with the cable guide 25E and core holder 27E, close it to hold the round cable 26E in the groove 24F of cable support 24E. The coil spring 29E is designed to exert a proper force on the round cable 26E to prevent any displacement of the round cable. A groove 27G is provided on the bottom of round cable holder 27F at the position corresponding to the groove 24F to ease the positioning of a round cable, but it may be eliminated if desired.

A cable stopper 30E is located in front of the cable support 24E to position the front ends of respective cable cores 26F when the cable support 24E is retracted or moved back in the farthest position from the feed rail 1. A position plate 31E is secured to the side of cable support 24A opposite to the hinged side and puts a sensor 32A into operation when the cable support is in the retracted position and a sensor 33A into operation when the cable support is in the advanced position or the closest to the feed rail 1.

Upon completion of the connecting operation, the cable support 24E is retracted or located at the farthest position from the feed rail 1. The position plate 31E is projected from the side of cable support 24E opposite to the side to which cable holders 27E and 27F are hinged. A sensor 32E is activated when the cable support 24E is in the retracted position, while a sensor 33E is activated when the cable support 24E is in the advanced position. A retract means 34E, such as a solenoid, is secured to the bottom of the base 21E. It is energized to lower the cable stopper 30E by pressing a foot switch (not shown) and kept energized until the sensor 33E senses twice the presence of position plate 31E and the sensor 32E senses once the presence of position plate 31E. By depressing again the foot switch after the multicore round cable 26E is removed, it is de-energized to release the cable stopper 30E to the original position. The other structures are identical with those of FIGS. 1 to 6, and their description is omitted.

In operation, first draw a terminal strip 2 from a supply source and place it in the guiding groove 3 of feed rail 1 through the guiding roller 16 so that the sprocket wheel 4 may engage an aperture 5 of the terminal strip. Then, turn the fixing bar 11 to place the pressure roller 10 on the terminal strip 2, and press the foot switch (not shown) to actuate the step motor 6. The step motor is moved intermittently according to the number of presses of the foot switch to rotate the sprocket wheel 4, moving intermittently the terminal strip 2 toward the lower press punch 53. When the terminal strip 2 reaches a predetermined position on the lower press punch 53, stop pressing the foot switch.

Next, open the cable holders 27E and 27F against the respective coil springs to place a multicore round cable 26E on the cable support 24E so that the multicore cable and respective cable cores 26F may be fitted in the grooves 24F and 25E, respectively, and the front ends of respective cable cores 26F may abut the cable stopper 30E. Close the cable core holder 27E to hold the cable cores 26F in place by the action of the coil spring and then close the round cable holder 27F to hold the multicore cable 26E in place by the action of coil spring 29E.

Then, press another foot switch (not shown) to energize the solenoid 34E, lowering the cable stopper 30E. Then, advance the cable support 24E toward the lower press punch 53 with the lever 23E to insert the front ends of respective cable cores 26F into respective contact terminals of terminal strip 2. When the sensors 32E and 33E sense this condition, the electric press 52 is actuated to move the upper press punch 51 down toward the lower press punch 53. The positioning pin **51*a* is inserted into an aperture of the terminal strip 2 through the guiding hole 59. The upper press punch 51 pushes the movable part 54 of lower punch 53 down to the base 21E, severing the contact terminal from the terminal strip 2 with the rear edge of the rear part of upper punch 51 and the front edge of rear part 57 of the lower punch. As the upper punch 51 and the movable part 54 of lower punch 53 continue going down to the base 21E, respective contact terminals are connected to the front ends of respective cores 26F between the front part of upper punch 51 and the fixed front part of lower punch 53. Upon completion of the connecting operation, the upper and lower punches 51 and 53** are returned to their original positions.

Then, the cable support 24E is retracted by manipulating the lever 23E. When the cable support 24E is in the retracted position, the step moter 6 is automatically driven to rotate to a predetermined number of pitches while the sensor 9 counts the number of pitches, advancing the terminal strip 2 to the same position as that of the previous connecting operation. The cable support 24E is then advanced toward the lower punch 53 to repeat the above connecting operation. Upon completion of the connecting operation, the cable support 24E is retracted with the lever 23E, and the cable holders 27E and 27F are opened to remove the multicore round cable 26E from the cable support 24E.

A new multicore round cable may be connected to contact terminals by repeating the above operation after the cable stopper 30E is raised by pressing the other foot switch. Alternatively, cable stopper may be made to move in response to a signal from the sensor or movement of the cable support.

According to the invention, the first and second guides are provided to position a cable in two directions at right angles, and the second guide is slidable in one of the directions to advance or retract the cable so that the positioning operation is very easy and fast with high precision. The subsequent operation of the cable is also speeded up.

Although the preferred embodiments of the present invention have been described above, other embodiments and modifications which would be apparent to one having ordinary skill in the art are intended to be covered by the spirit and scope of the invention as defined in the appended claims.

What is claimed is:

1. Apparatus for connecting by pressure a plurality of insulated conductors of a multiconductor flat cable to a plurality of contact terminals attached at an end to a terminal strip having a plurality of guide apertures spaced at equal intervals along said terminal strip, which includes:

a feed rail with a guiding groove along which said terminal strip is fed;

a sprocket wheel for advancing said terminal strip by engaging said guide apertures;

a step motor for intermittently rotating said sprocket wheel;

a pair of upper and lower punches, with said lower punch provided on level with said guiding groove;

a generally rectangular cable support station secured at substantially right angles to a side of said feed rail to advance said multiconductor flat cable toward said contact terminals placed on said lower punch for insertion of respective insulated conductors of said multiconductor flat cable into said contact terminals; and press means for moving said upper punch toward said lower punch to press said contact terminals into said insulated conductors of said multiconductor flat cable for connection by pressure, wherein said cable support station comprises:

a base plate with a support groove;

a cable support slidable along said support groove;

a cable guide provided on said slidable cable support against which a side of said multiconductor flat cable is to be abutted for positioning;

a cable holder for holding said multiconductor flat cable in place along said cable guide on said slidable cable support;

a cable stopper for positioning respective insulated conductors of said multiconductor flat cable held on said slidable cable support with said cable holder along said cable guide; and lowering means for lowering said cable stopper below a horizontal plane in which said slidable cable support is movable.

2. The apparatus of claim 1, wherein said lowering means includes a solenoid secured to a bottom of said base plate and a link for connecting said solenoid to said cable stopper.

3. Apparatus for simultaneously terminating a plurality of insulated conductors of a multiconductor cable to a plurality of contact terminals connected to a terminal strip having a plurality of guide apertures at equal intervals, which comprises:

press means in which said contact terminals are pressed into said insulated conductors for connection by pressure;

feeding means for intermittently feeding said terminal strip into said press means; said feeding means including:

a feed rail extending laterally to said press means;

a sprocket wheel pivoted to an end portion of said feed rail opposite to said press means for engagement with said guide apertures to feed said terminal strip into said press means;

a step motor for intermittently rotating said sprocket wheel; and control means responsive to an input signal to control an angle of rotation of said step motor such that a predetermined number of said contact terminals are fed into said press means with a difference by one pitch of said insulated conductors from a previous amount of feed, whereby said insulated conductors are terminated to every other said contact terminals spaced along said terminal strip at intervals twice as large as those of said insulated conductors; and alignment means for holding said multiconductor cable in alignment with said contact terminals in said press means.

4. The apparatus of claim 3, wherein said feeding means further comprises a pressure roller provided at a position opposite to said sprocket wheel with respect to said terminal strip for preventing said terminal strip from falling off said feed rail.

5. The apparatus of claim 3, wherein said control means comprises:

disk means secured to said step motor and having a plurality of apertures spaced at equal intervals along the circumference of said disk means; and an optical sensor for sensing the number of apertures which have passed through said disk means.

6. Apparatus for simultaneously terminating a plurality of insulated conductors of a multiconductor cable to a plurality of contact terminals connected to a terminal strip having a plurality of guide apertures at equal intervals which comprises:

press means in which said contact terminals are pressed into said insulated conductors for connection by pressure;

feeding means for intermittently feeding said terminal strip into said press means; and alignment means for holding said multiconductor cable in alignment with said contact terminals in said press means, said alignment means including:

a cable support with a generally rectangular shape which is movable on said alignment means in a normal direction perpendicular to a longitudinal axis of said feeding means and has a cable guide along an edge in said normal direction;

a cable holder with a substantially L-shaped form, with a leg hinged to the edge opposite to said edge for holding said multiconductor cable with a side abutting said cable guide with a pressure applied to said multiconductor cable in a vertical direction perpendicular to a plane of said cable support; and a cable stopper vertically movable in front of said cable holder between upper and lower positions; at said upper position, ends of said insulated conductors are abutted against a flat face of said cable stopper for positioning and at said lower position, said insulated conductors are advanced into said press means for effecting connection by pressure.

7. The apparatus of claim 6, wherein said cable guide is made fixedly integral with said cable support.

8. The apparatus of claim 6, wherein said cable guide is made movable in a direction parallel to said longitudinal axis of said feeding means.

9. The apparatus of claim 6, wherein said alignment means further includes a slidable base movable in a direction parallel to said longitudinal axis to thereby permit placement of multiconductor cables of different numbers of insulated conductors.

10. The apparatus of claim 6, wherein said cable support has on its top a plurality of alignment grooves parallel to said normal direction for alignment of said insulated conductors.

11. The apparatus of claim 6, wherein said cable support is provided on a side wall with a position plate which actuates a first sensor when said cable support is in a retracted position and a second sensor when said cable support is in an advanced position.

* * * * *